US010669066B2

(12) United States Patent
Welschoff

(10) Patent No.: US 10,669,066 B2
(45) Date of Patent: Jun. 2, 2020

(54) NESTABLE ONE QUART HALF GALLON AND ONE GALLON SIZE PAINT CANS FOR OPENING AND CLOSING THEM WITHOUT THE NEED OF ANY TOOLS

(71) Applicant: Heinz Welschoff, Pompano Beach, FL (US)

(72) Inventor: Heinz Welschoff, Pompano Beach, FL (US)

( * ) Notice: Subject to any disclaimer, the term of this patent is extended or adjusted under 35 U.S.C. 154(b) by 0 days.

(21) Appl. No.: 16/417,975

(22) Filed: May 21, 2019

(65) Prior Publication Data

US 2019/0359380 A1 Nov. 28, 2019

Related U.S. Application Data

(60) Provisional application No. 62/675,316, filed on May 23, 2018.

(51) Int. Cl.

| | |
|---|---|
| ***B65D 21/032*** | (2006.01) |
| ***B65D 21/04*** | (2006.01) |
| ***B65D 21/02*** | (2006.01) |
| ***B65D 41/04*** | (2006.01) |
| ***B44D 3/12*** | (2006.01) |

(52) U.S. Cl.

CPC ..... *B65D 21/048* (2013.01); *B44D 3/127* (2013.01); *B44D 3/128* (2013.01); *B65D 21/0233* (2013.01); *B65D 41/0485* (2013.01); *B65D 2251/023* (2013.01)

(58) Field of Classification Search

CPC .... B65D 21/0233; B65D 21/04; B44D 3/128; B44D 3/127

USPC ..... 220/254.8, 700, 701; 222/566, 568

See application file for complete search history.

(56) References Cited

U.S. PATENT DOCUMENTS

| | | | | | |
|---|---|---|---|---|---|
| 1,509,452 | A * | 9/1924 | Taras | B65D 25/46 | 222/489 |
| 2,786,495 | A * | 3/1957 | Benson | A47G 19/12 | 141/370 |
| 4,125,210 | A * | 11/1978 | Embree | B44D 3/128 | 220/254.7 |
| 5,533,802 | A * | 7/1996 | Garganese | B01F 13/002 | 366/256 |
| 2004/0149617 | A1* | 8/2004 | Schutz | B65D 1/16 | 206/503 |

* cited by examiner

*Primary Examiner* — Stephen J Castellano

(74) *Attorney, Agent, or Firm* — Melvin K. Silverman

(57) ABSTRACT

A nestable paint container having a main body can having a can bottom, the can is used for receiving paint, the paint body having tapering sidewalls; a circumferential paint can cover and grooved against an uppermost region beneath a rim of an upper side of the main body can; a small central can cover cap about an open small circular opening in the can cover; a substantially circular spline gripping element; and a drip spout.

7 Claims, 12 Drawing Sheets

NESTABLE ONE QUART HALF GALLON AND ONE GALLON SIZE PAINT CANS FOR OPENING AND CLOSING THEM WITHOUT THE NEED OF ANY TOOLS

This application claims benefit of provisional application No. 62/675,316 filed May 3, 2018.

FIELD OF THE INVENTION

The invention relates to paint cans and more particularly, using a system of a multiplicity of nestable cans.

BACKGROUND OF THE INVENTION

Paint cans are made out of metal or plastic and are commonly used to hold paint products. The existing types of one quart and one-gallon paint cans are made out of plastic or metal, and contain more than three parts, and require various machine and hand labor operations to manufacture. The existing metal or plastic can covers require opening tools, and require a press to close the cover, which is commonly done with the use of a hammer. There is also noise when closing the cover with a hammer. Both operations are time consuming, and risk hand/wrist strain. When closing the cover with a hammer, any paint left-over inside the circular groove of the can will splash. Also, paint commonly runs down the outside of the can and thus would rarely be cleaned off.

One approach to eliminating this problem has been to provide an inner lip on the bucket, so that excess paint wiped against the tip drips back into the bucket and not on the floor. Examples of such buckets include: U.S. Pat. No. 6,609,629 to Lucey, which has a lip extending outward, with a configuration said to allow multiple buckets to be stacked. U.S. Pat. No. 4,615,456 to Cousar shows a modular bucket with space for a brush to rest. U.S. Pat. No. 1,696,240 to Kircher, Jr. shows a metal bucket having a lip brace extending radially between its rim and lip; the brace is generally coplanar to the rim. Neither of the above patents describe a loop brace attached below to the rim to a sidewall of a paint bucket, with the brace forming a trough for stowage of applicator brush or rollers, nor is such a bucket described that is optionally stackable for retail display.

Other art of interest are U.S. Pat. No. 3,442,420 to Edwards, U.S. Pat. No. 4,181,226 to Weinert, and U.S. Pat. No. 7,428,977 to Fera with a Dripless Paint Bucket.

Other problems with metal can covers can arise after a short time; the cans and their covers start to rust. Many times, the cover is not completely sealed. In those situations, the paint can become dry, useless and wasteful. Also, it creates an environmental problem. The plastic paint cans basically have the same problems as the metal ones. Some plastic paint cans also have metal parts. This creates a dual problem drying paint and rusting metal parts.

Both types of paint cans are very hard to be completely cleaned. Most painters do not take the time to clean inside and the circular cover groove at the top.

As is known, manufacturers produce one quart and one-gallon paint cans, metal or plastic, and store them in boxes. When shipping these cans by placing them in boxes, there is a considerable amount of wasted space resulting in excess costs.

SUMMARY OF THE INVENTION

A nestable paint container comprising a three-part system having a tapered main body, lid, and lid cap. The system providing a closed bottom of the main body and circular sidewalls thereof and an opening opposite of said closed bottom. The paint can body above the hollow grooved ring is a vertical straight threading. An internally threaded paint can lid that screws onto the externally treaded upper surface of the sidewalls of the body of the paint container. The paint container lid contains an opening on its upper surface defined by an extended hallow neck and the extended neck contains an external thread. The paint container lid contains vertical spline elements on the semi-circular surface of a protruding ring thus for the use of a specialized wrench for the screwing and unscrewing of a lid to and from the threaded paint container body. The paint container lid has external threading on the neck is to receive the internally threaded cap. The paint container also containing a drip spout located along upper surface of said lid extending from a base portion of said outwardly extending threaded hollow neck to just beyond a perimeter of said lid It is an object of the present invention to provide an improved stacking device in the form of a thermoplastic or steel nestable container.

Another object is to provide a thin-wall plastic or steel container which is not difficult to form, consistently functioning as a stacking device, and does not interfere, to any great extent, with the volume or capacity of the container.

A further object of the present invention is to provide a stacking system in a thin-walled seamless thermoplastic or steel container which is easy to remove from molding machinery and yet provides a stacking function consistent with industry standards.

It is also an object to provide a complete manufacturing process is without complicated and costly assembly lines, machinery, operation and maintenance cost, is fast and simple, includes no manual labor, saves space, provides savings in shipping cost, and is much cleaner.

Also, all paint cans, covers and caps can be molded in any color and may have the color and logo design of a company.

In a preferred embodiment, the rim, bottom and sidewall dimensions of the bucket are shaped and sized to allow stacking of multiple buckets for retail display. More preferably, the buckets are of a unitary molded plastic or steel construction.

Other objects and advantages will become apparent to a reader skilled in the art, with reference to the following Figures and accompanying Detailed Description wherein textual reference characters correspond to those denoted on the drawings.

DETAILED DESCRIPTION OF THE INVENTION

Figure 1:
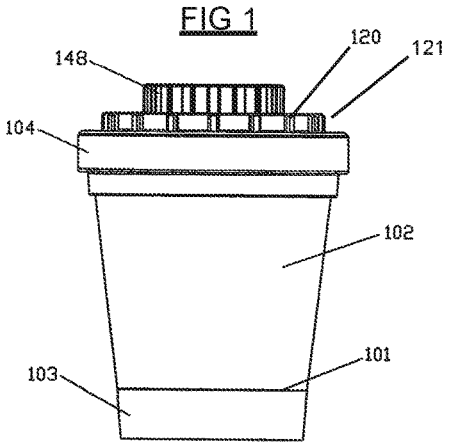
FIG. 1 provides a complete vertical assembled rear view of the paint can.
Figure 3:
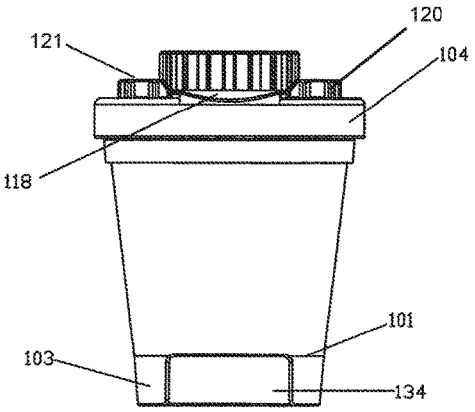
FIG. 3 provides a front view of the vertical assembly of the paint can.
Figure 2:
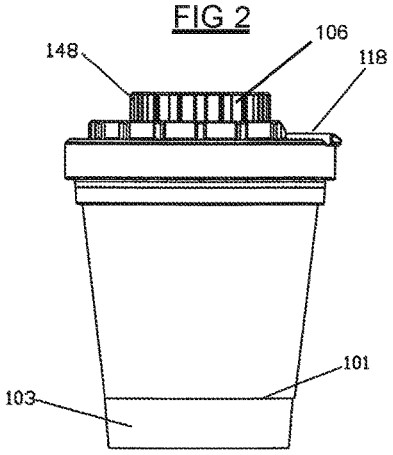
FIG. 2 is an opposite side view of the vertical assembly of the paint can of FIG. 1.
Figure 4:
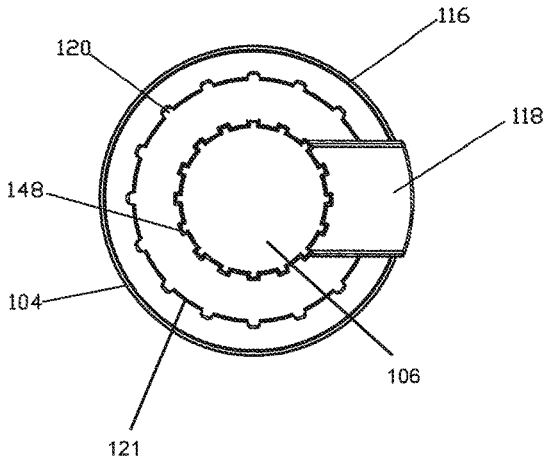
FIG. 4 is a top view of the paint can and lid.
Figure 5:
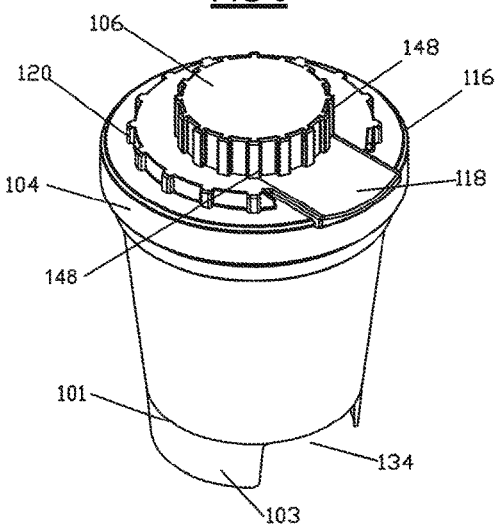
FIG. 5 is a front perspective view of the paint can.

FIGS. 1-2 show the present inventive paint can, specifically, the can body 102, lid 104 which includes an outward facing surface with gripping spline 120 on a semi-circular protrusion 121 (see also FIG. 4). Also provided in FIGS. 2 and 5 is a cap 106. As such, the vertical assembly is shown primarily in FIGS. 1-3 and 5.

As may be seen, can body 102 comprises conical tapered sidewalls. Further, the structure provides for a can bottom 103 and a false bottom 101 (described more fully below).

Lid 104 is shown in FIGS. 1-5 along with the gripping spline 120 of said lid 104.

FIG. 2 is a side view of the can shown in FIGS. 1 and 2. FIG. 4 is a top view of the can shown in FIG. 2.

Figure 6:
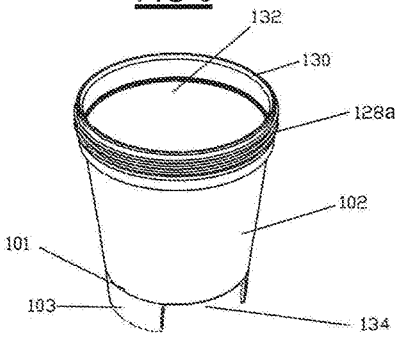
FIG. 6 is a perspective front view of the can body.

Drip spout 118 (see also FIG. 4) exists on the surface of the lid 104, between the edge/perimeter 116 of the lid 104 and the cap 106. As such, the drip spout 118 is shown in FIGS. 3, 4, 7B and 7A. Also shown is the false bottom 101 of the can body 102 and, therein, the can bottom 103 as is shown in FIGS. 3, 5 and 6. Further, in FIG. 4, a gripping spline 120 is shown as an essential aspect of the lid 104. Similarly, a cap gripping spline 148 exists as an essential aspect of the cap 106

Figure 7B:
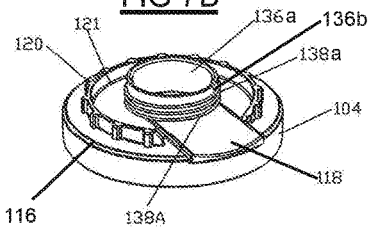
FIG. 7B is a perspective front view of the lid.
Figure 7A:
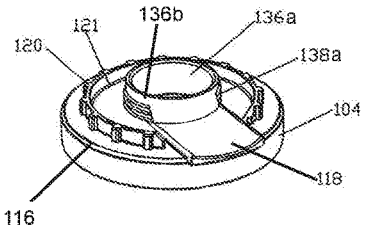
FIG. 7A is a perspective front view of an alternative lid without continuous threading.

In FIGS. 4, 5, 7B and 7A, the lid 104 is shown to have a perimeter edge 116, drip spout 118, and gripping spline elements 120. FIGS. 4 and 5 provide a view of cap 106, and cap gripping spline elements 148, while FIGS. 7B and 7A show the lid 104 without a cap.

In FIG. 7B and FIG. 7A, the external threading 138*a* of the hollow neck 136*b* of the lid 104 is circumferential about the hollow neck 136*b* of the lid 104.

Figure 8C:
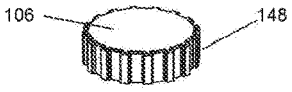
FIG. 8C is a perspective view of the cap.

FIG. 8C shows a cap 106, with vertical splines 148.

Figure 8A:
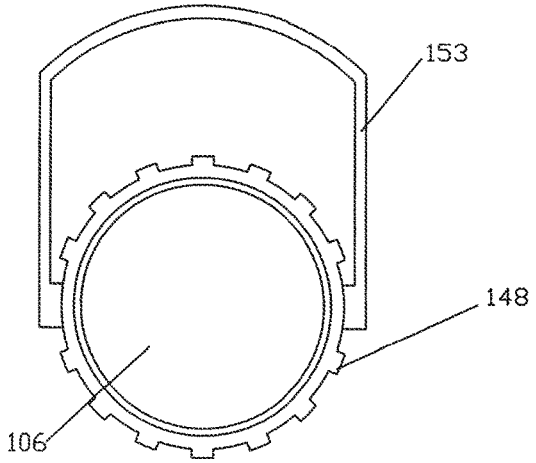
FIG. 8A is a bottom view of a cap with a handle.

FIG. 8A shows a bottom view of the cap 106, wherein said cap 106 includes a carrying handle 153.

Figure 8B:
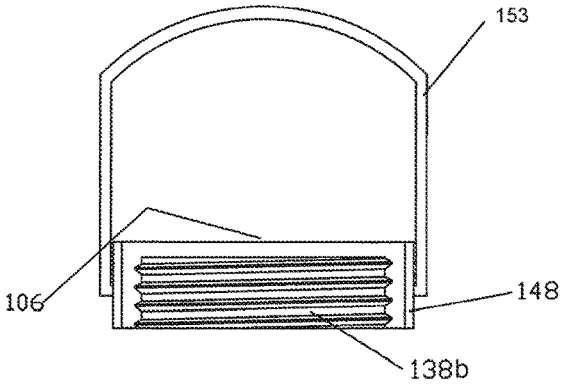
FIG. 8B is a side elevation view of a cap with a handle.
Figure 9:
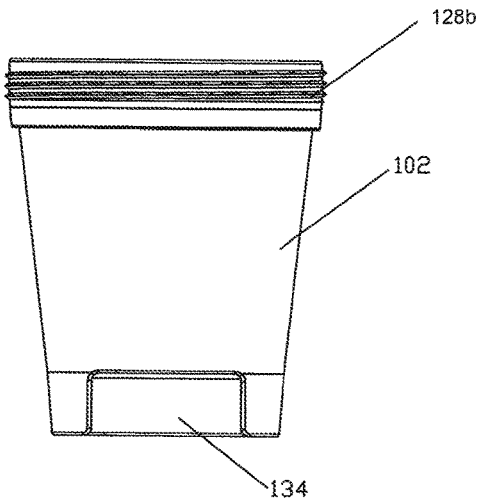
FIG. 9 is a front view of the can body.

FIG. 8B shows a side cross-sectional view of the cap 106, wherein said cap 106 includes a carrying handle 153. Further shown is internal threading 138*b* of the cap 106, and gripping spline elements 148 on the outside of the cap 106.

Therein, when paint is put into the can body 102, the lowermost part of the inner can body 102 is the false bottom 101, which is a closed bottom, that closes off the bottom of the container, but exists above the base, which is the lowermost area of the container, and said base is defined by an arc-like wall 103 along the circumferential edge of the false bottom 101, wherein the arc-like wall 103 contains a front base cutout 134 providing a gap in the arc-like wall (see FIGS. 1-3 and FIGS. 5, 6, 9, 10, 11).

In FIG. 6 also shows the paint can body opening 132 defined by a paint can body edge 130. The edge 130 also defines a circular sidewall between edge 130 and false bottom 101. As may be noticed in FIGS. 1-3, 5, 6, and 9-11, the circular sidewall defined by edge 130 and false bottom 101 is tapered and provides a tapered inner surface, as may be noticed by the smaller circumference of the false bottom 101 than the edge 130. Further shown therein is the use of paint can body threading 128*b* (see also FIGS. 9-10). Whenever closure of can is required, the complimentally threaded lid 104 is engaged. (See FIGS. 1 and 5).

Figure 10:
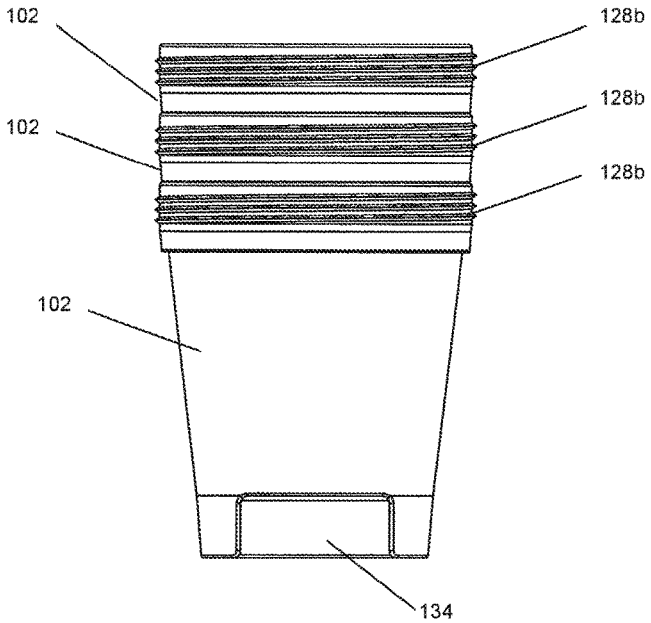
FIG. 10 is a front vertical view of the cans nested into each other.
Figure 11:
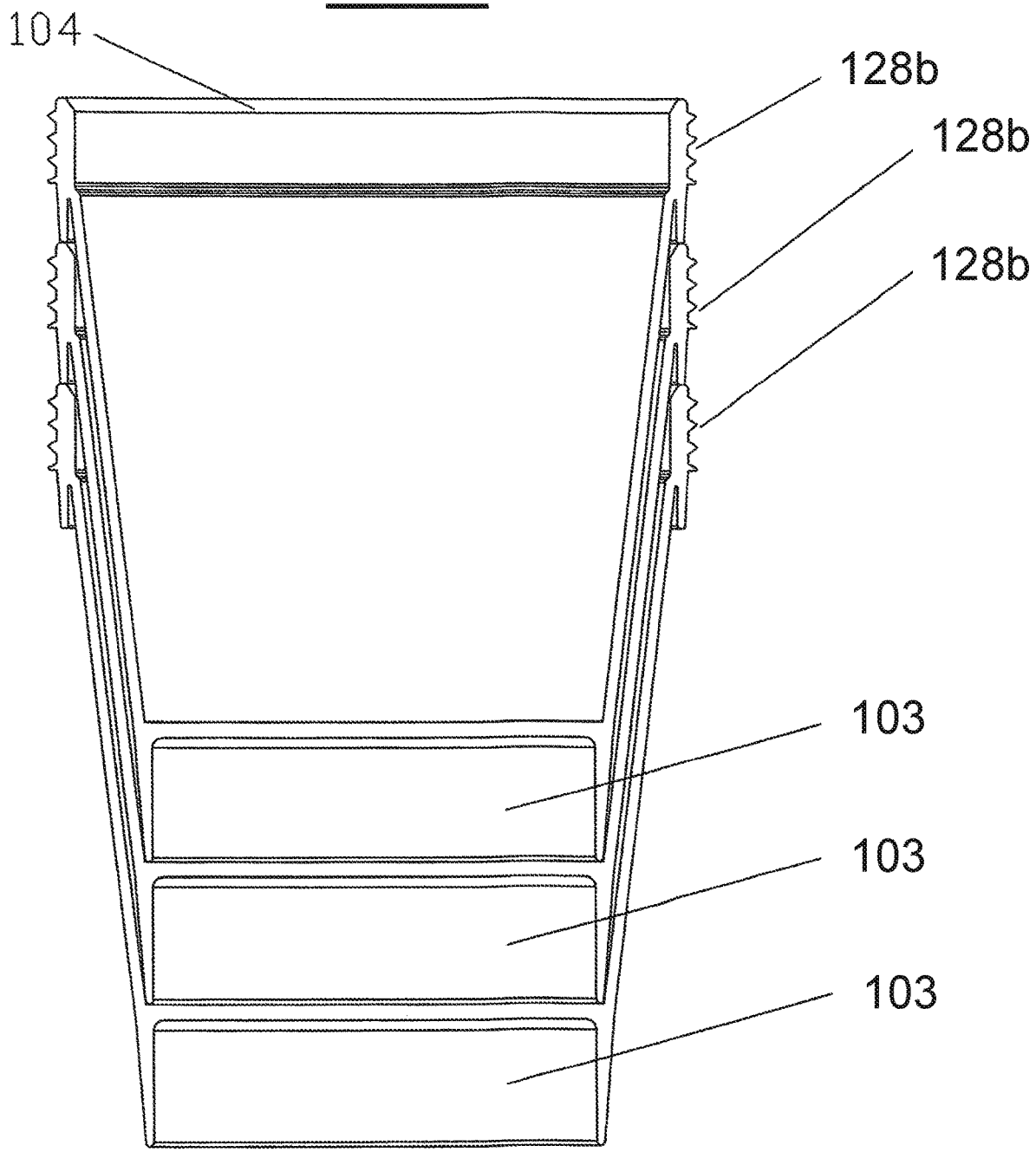
FIG. 11 is a vertical cut away view whereas the cans are nested into each other.
Figure 12:
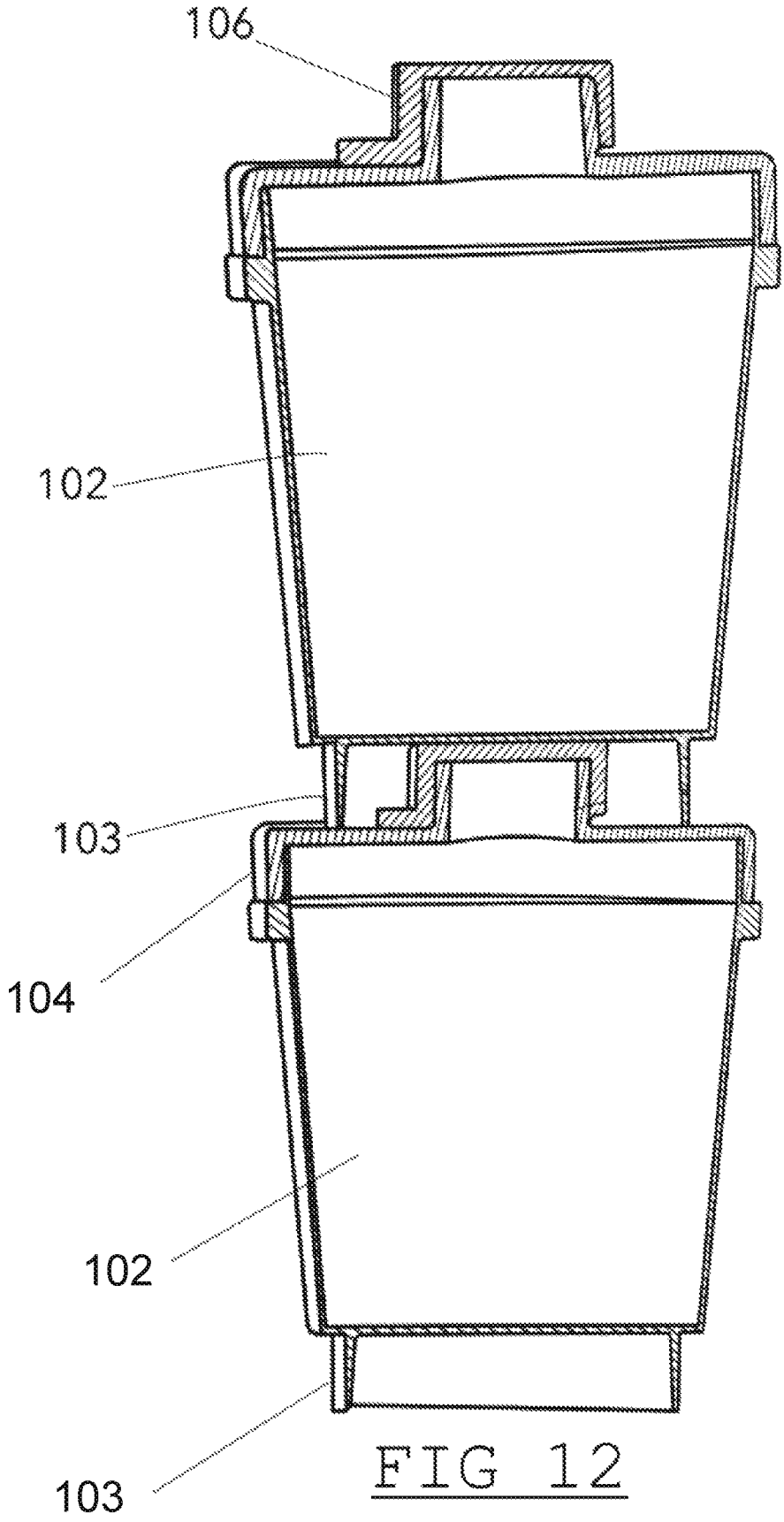
FIG. 12 is a front view of two cans covered with the cover stacked on top of each other.

FIGS. 10-11 show nesting of a first can body 102, into a second can body 102, which is nested into a third can body 102. FIG. 11 is a cross-sectional view showing the nesting orientation of FIG. 10. FIG. 12 shows a stacking orientation of the completed system of paint cans, wherein the circular sidewall 103*a* of the first paint can system is shown engaging the lid 104*b* of a second paint can system.

Figure 13:
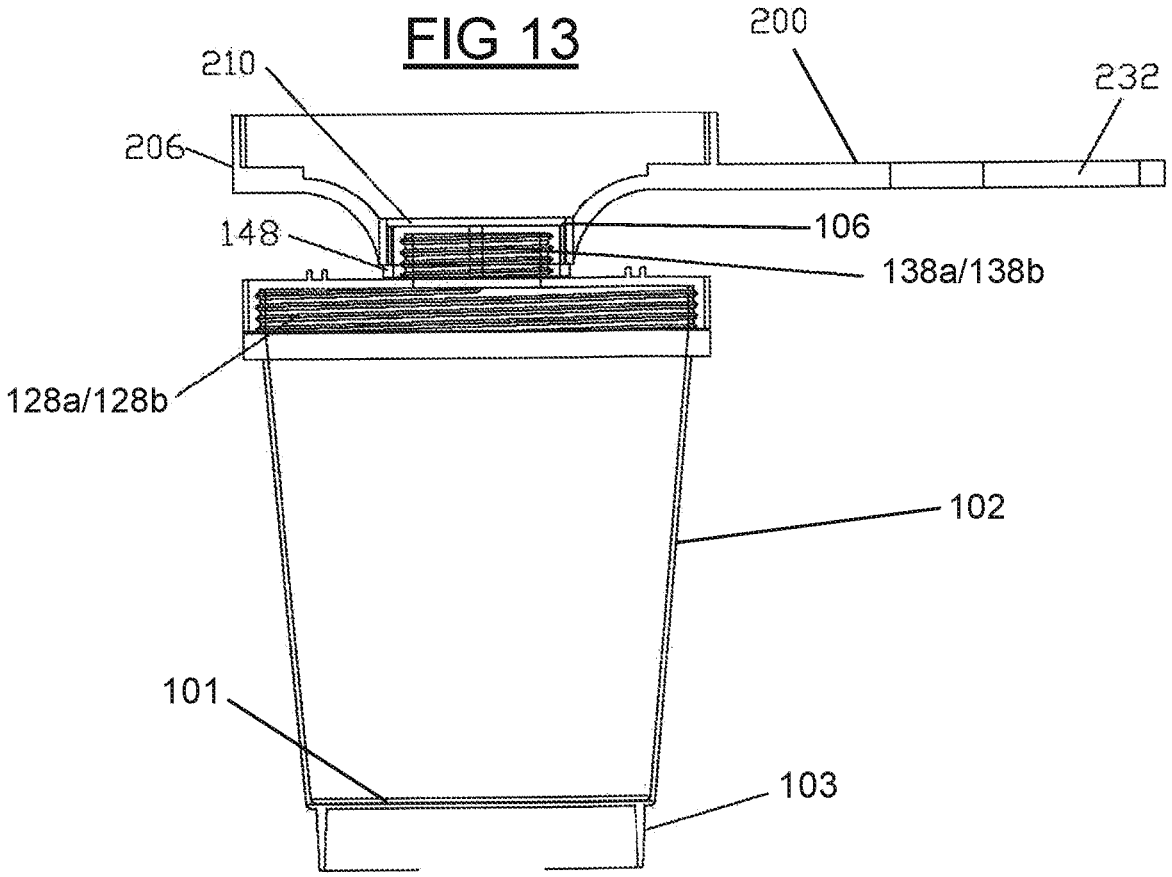
FIG. 13 is a cross-section view of the paint can system engaging with a special purpose wrench engaged with the cap of the paint can system.
Figure 19:
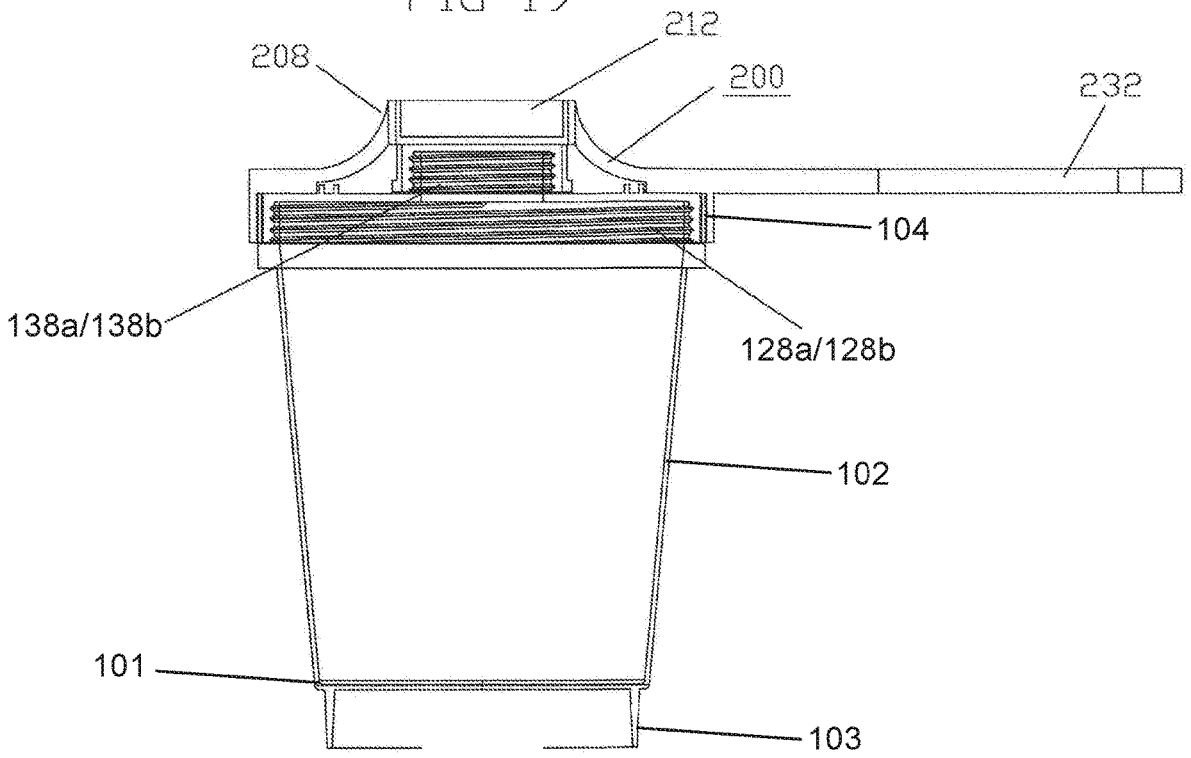
FIG. 19 a cross-section view of the paint can system engaging with a special purpose wrench engaged with the lid of the paint can system.

FIGS. 13 and 19 are views of the engagement of the special purpose wrench 200 as used for the opening or closing of the cap 106 on the threaded cover neck 138*a* and for opening or closing of the lid 104 on the threaded surface 128*b* of the can body 102. FIGS. 13 and 19 also show complemental engagement of threaded cover neck 138*a* with complemental threads 138*b* on the inside surface of the cap 106. FIGS. 13 and 19 also show complemental engagement of threaded surface 128*b* with complemental threading 128*a* on the inner side of the lid 104. As may be seen in FIG. 15, the particular wrench provides a given geometry of the inner spline 222 that engages with gripping spline 148 of the cap 106. Said special purpose wrench 200, with its handle 232, provides a high degree of leverage against the outer spline 148 of the cap 106.

Figure 20:
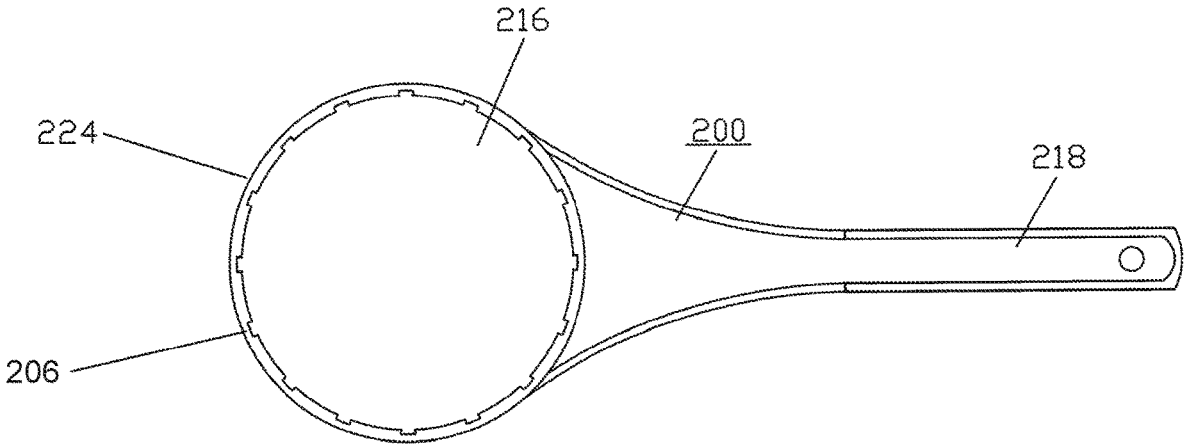
FIG. 20 is a bottom view of the special wrench for opening and closing of the threaded cover neck of the inner spline walls.

Further shown in FIG. 20 is the particular wrench, which provides a given geometry of the lower inner spline 206 that engages with gripping spline 120 of the lid 104. Said special purpose wrench 200, with its handle 232, provides a high degree of leverage against the outer spline 120 of the lid 104.

Figure 15:
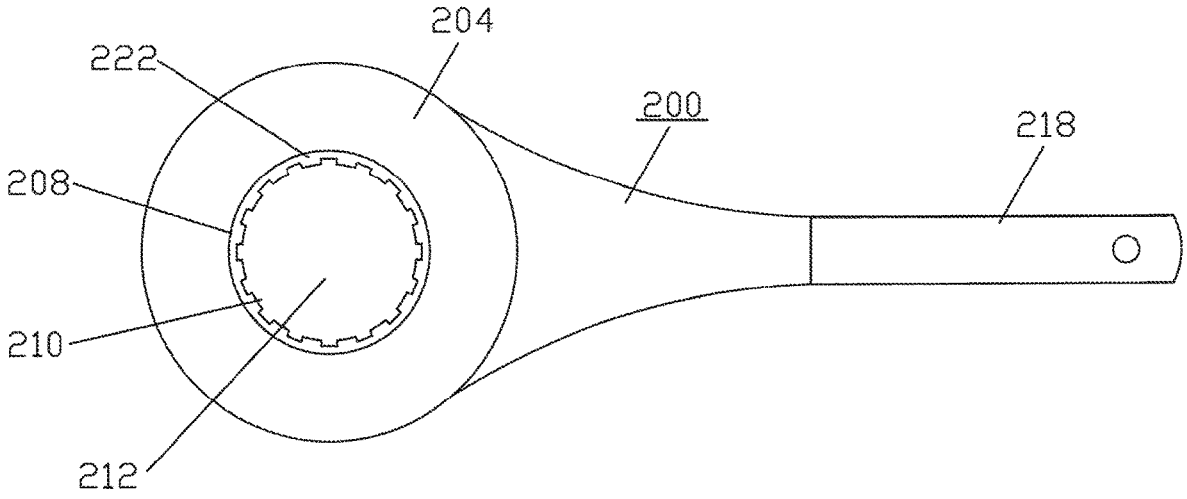
FIG. 15 is a top view of the special wrench for opening and closing of the threaded cover neck of the inner spline walls.
Figure 16:
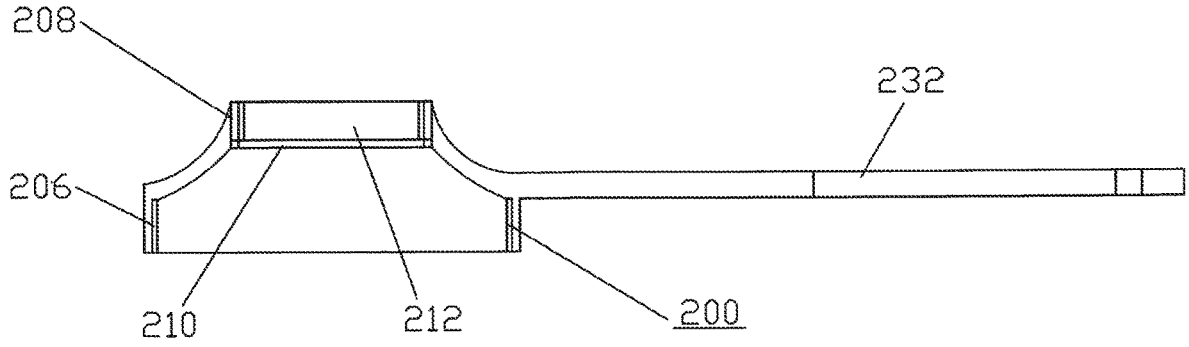
FIG. 16 is a side view of the special wrench for opening and closing of the threaded cover neck of the inner spline walls.

FIGS. 15 and 16 are top and side views of said special purpose wrench 200 for opening and closing of said lid 104. Also, shown is outer wall 208. Also, shown is inner spline 222, complementary to spline 148 of cap 106, and a central empty space 212 of the wrench, for receiving cap 106, to be placed on top of the cap 106 and engaged with vertical splines 148 connected to the cap 106. Also shown are inner surface 210, handle 218, side of handle 232, curved surface 204 of outer wall 208, and inner spline elements 206.

Figure 21:
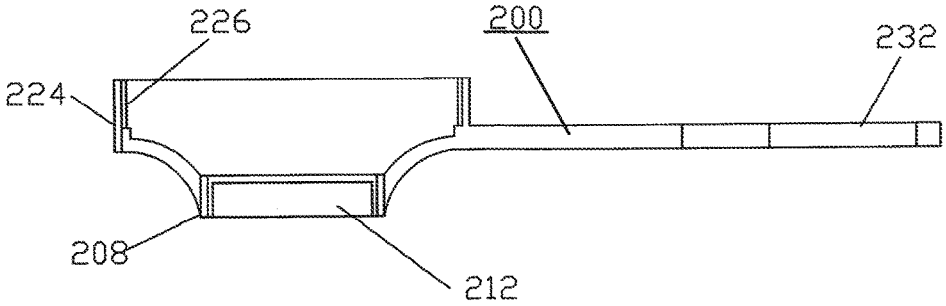
FIG. 21 is a side view of the special wrench for opening and closing of the threaded cover neck of the inner spline walls, opposite of the view of FIG. 16.

FIGS. 20 and 21 are bottom and side views of said special purpose wrench 200. Also, shown is inner spline 206, complementary to spline 120 of lid 104, and a central empty space 216 of the wrench, for receiving lid 104, to be placed on top of the lid 104 and engaged with vertical splines 120 connected to the lid 104. Also shown are central empty space 212, handle 218, side of handle 232, vertical surface 224 of outer wall 208, and inner spline elements 206.

Figure 14B:
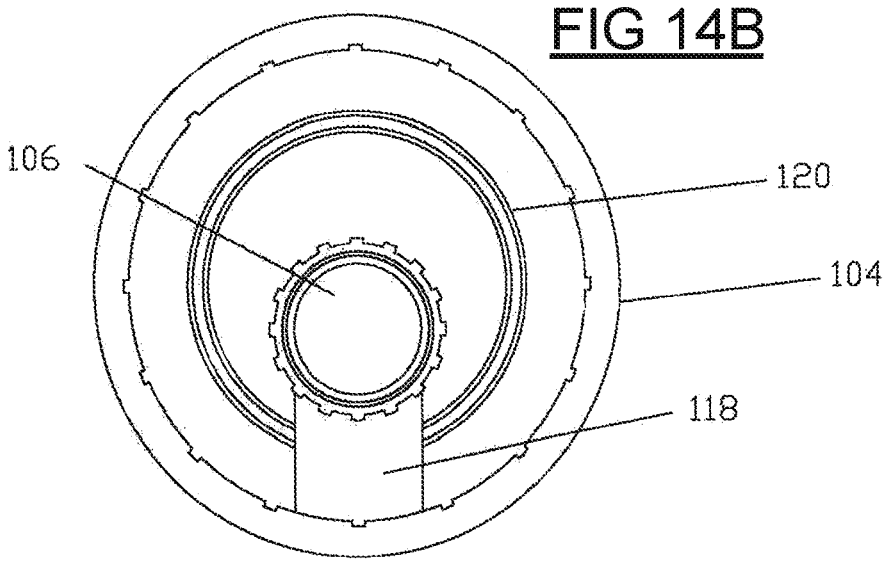
FIG. 14B is a view of the lid as shown in FIG. 4 with the cap engaged.
Figure 14A:
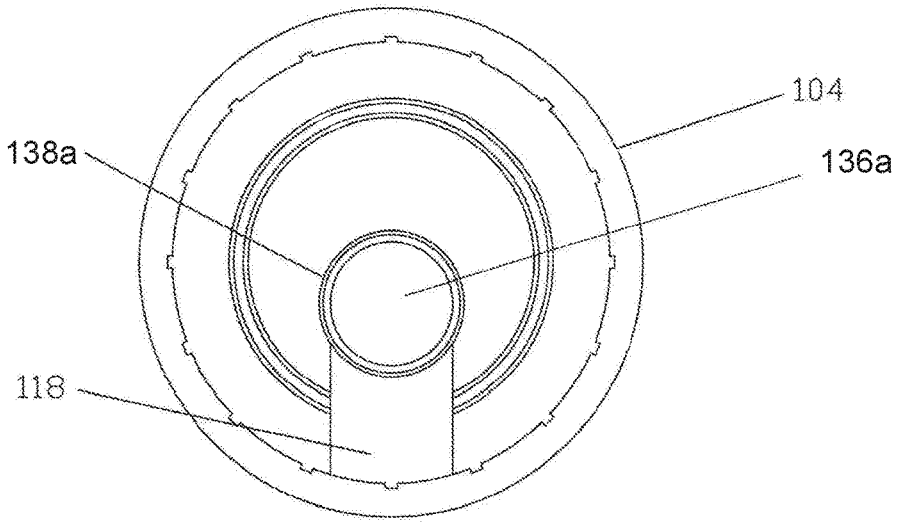
FIG. 14A is a view of the lid as shown in FIG. 4 with the cap removed showing the lid opening.
Figure 17:
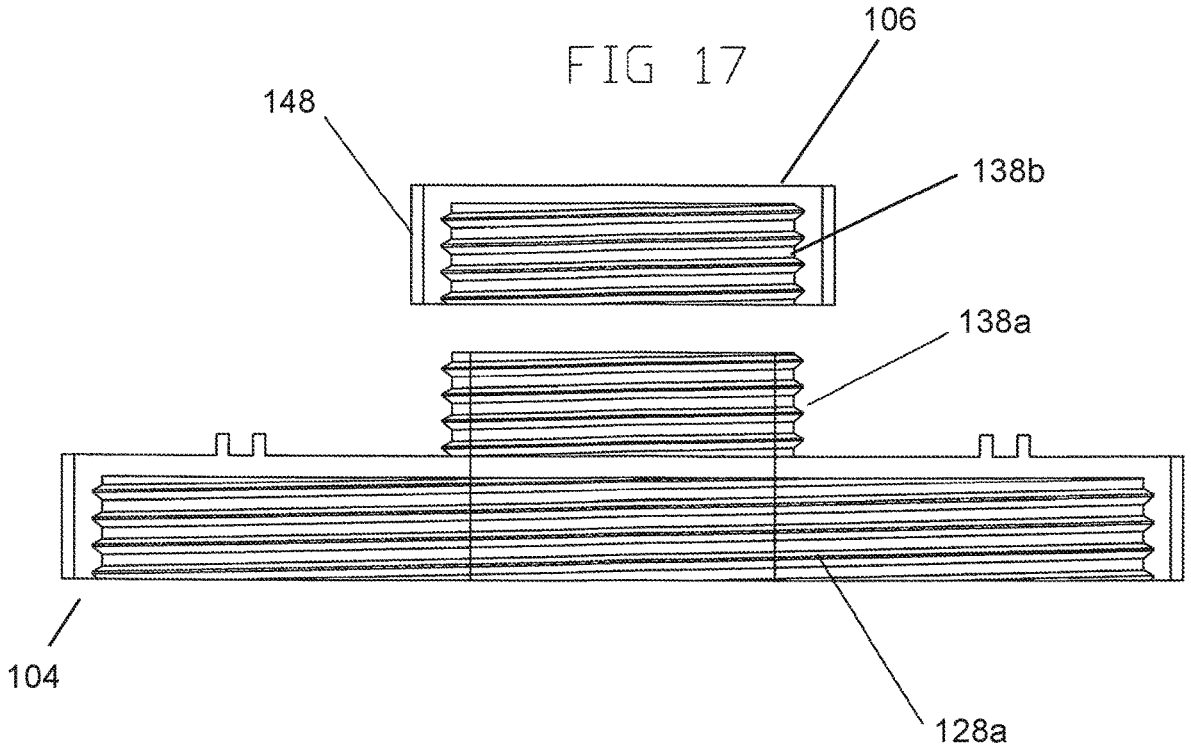
FIG. 17 is a cross-sectional view of the lid and the cap showing the threading of the two parts disengaged.

FIG. 17 is a side cut view of the lid 104 with the cap 106 with gripping spline 148 removed from the hollow neck 136*b* of the lid 104 showing the threads 138*a* on the outside surface of the hollow neck 136*b* and threads 138*b* on the inside surface of the cap 106. Lid threading 128*a* that engages with can body threads 128*b* can be seen in the figure as well. FIG. 14A represents a top-view of the lid 104 as shown in FIG. 17, without the cap 106, showing the lid opening 136*a*.

Figure 18:
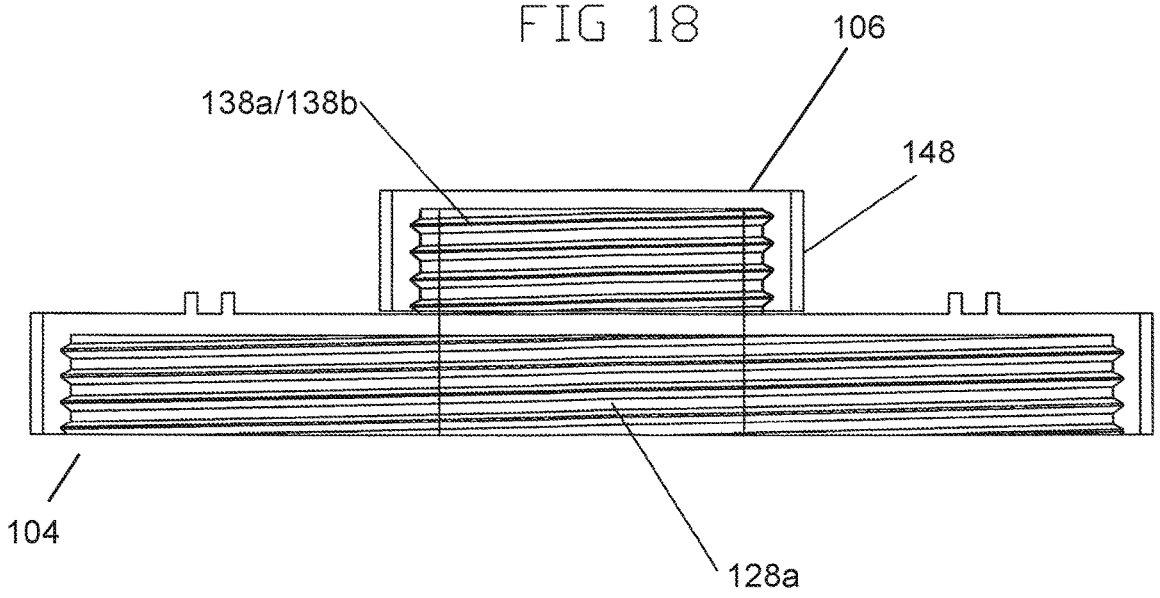
FIG. 18 is a cross-sectional view of the lid and the cap showing the threading of the two parts engaged.

FIG. 18 is a side cut view of the lid 104 with the cap 106 with gripping spline 148, wherein said cap is engaged with the hollow neck 136*b* of the lid 104, and showing the threads 138*a* on the outside surface of the hollow neck 136*b* engaged with threads 138*b* on the inside surface of the cap 106. Lid threading 128*a* that engages with can body threads 128*b* can be seen in the figure as well. FIG. 14B represents a top-view of the lid 104 as shown in FIG. 17, the cap 106.

While there has been shown and described above the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

I claim:

1. A nestable paint container, comprising:

a three-part system including a main body, lid, and lid cap;

said main body having a closed bottom and circular sidewalls thereof and an opening opposite of said closed bottom, wherein said sidewalls are tapered with said closed bottom having a smaller circumference than said opening;

external threading on an outer upper surface of said sidewalls to allow complemental engagement from a lid to provide for closure of the container;

said lid having internal threading on an interior surface complemental to said threading on the outer upper surface of said sidewalls of said main body;

said lid also having an opening on its upper surface, wherein said opening is defined by an outwardly extending externally threaded hollow neck, wherein said threading allows for complemental engagement of a lid cap;

said lid cap having internal threading on sidewalls complemental to the threaded hollow neck of said lid, and a top surface connecting the sidewalls of said lid cap;

said lid cap having a plurality of vertical spline elements for grip spaced along an outer sidewall surface of said lid cap;

a drip spout located along upper surface of said lid extending from a base portion of said outwardly extending threaded hollow neck to just beyond a perimeter of said lid; and a semicircular protrusion located on said upper surface of said lid having spline elements for grip on an outward-facing surface of said semicircular protrusion.

2. The nestable paint container as recited in claim 1, further comprising:

a false bottom defined by a vertical arc-like wall along the circumferential edge of the closed bottom of the main body and open bottom below said closed bottom of the main body to provide spacing in situations of stacking closed containers, wherein said false bottom is configured to provide spacing between the lid of the main body of a first paint container and the closed bottom of the main body of a second paint container with enough space to accommodate the height of the externally threaded hollow neck and lid cap of said first container.

3. The nestable paint container as recited in claim 2, further comprising:

a front base cutout defined by a gap in said vertical arc-like wall along the circumferential edge of the closed bottom of the main body, wherein the dimensions of said front base cutout are configured to allow the drip spout of said first paint container to avoid interference with the vertical arc-like wall along the circumferential edge of the closed bottom of the main body of the second paint container.

4. The nestable paint container as recited in claim 1, wherein the tapered sidewall of said main body provides a tapered inner surface configured to allow a plurality of main bodies to be stacked, substantially within one another, resulting in a reduced volume for shipping, transport, and storing.

5. The nestable paint container as recited in claim 1, wherein the main body, lid, and lid cap are each a unitary piece molded from plastic.

6. The nestable paint container as recited in claim 1, wherein the main body, lid, and lid cap are each a unitary piece molded from metal.

7. The nestable paint container as recited in claim 1, wherein said opening on said lid's upper surface is centrally located on said lid's upper surface.

* * * * *